United States Patent [19]

Hurst

[11] 4,015,740

[45] Apr. 5, 1977

[54] INFANTS FEEDING BOTTLE

[75] Inventor: Eric Kenneth Hurst, London, England

[73] Assignee: Lewis Woolf Griptight Limited, Birmingham, England

[22] Filed: Sept. 17, 1975

[21] Appl. No.: 614,061

[52] U.S. Cl. ..... 215/11 C

[51] Int. Cl.[2] ..... A61J 9/00

[58] Field of Search ..... 215/11 R, 11 B, 11 C, 215/11 D

[56] References Cited

UNITED STATES PATENTS

| | | | |
|---|---|---|---|
| 3,677,429 | 7/1972 | LaBarge | 215/11 C |
| 3,779,413 | 12/1973 | Pickerell | 215/11 C |
| 3,844,436 | 10/1974 | Hurst | 215/11 C |

*Primary Examiner*—Donald F. Norton

[57] ABSTRACT

An infants feeding bottle comprising a container for liquid having an outlet opening surrounded by a seating, a resilient teat with an outlet orifice, the teat having a portion secured onto the seating of the container by an attachment part, a teat cap enclosing the teat and connected to the attachment part, the attachment part being through a severable portion which can be broken by manipulation of the cap, a closure member being frictionally engaged in the interior of the teat and arranged to be dislodged therefrom by a manipulation of the teat cap without removal thereof from a position in which it encloses the teat, dislodgement of the closure member allowing access between the interior of the container and of the teat.

4 Claims, 8 Drawing Figures

INFANTS FEEDING BOTTLE

This invention relates to an infants feeding bottle comprising a container for liquid, a teat securable onto the container, a detachable teat cap enclosing the teat before use, and means whereby, before use, the interior of the container is isolated from the interior of the teat.

It is desirable to isolate the interior of the container from the interior of the teat in prefilled and often presterilised feeding bottles since this prevents liquid drying in the teat and therefore clogging the outlet thereof during storage. It also reduces the risk of deterioration of the liquid contents of the container and also of the teat.

Many forms of apparatus have been proposed wherein the required isolation between the container and the teat is achieved. These include a rupturable diaphragm. Another form has a member which is, in the scaled condition, trapped between portions of the teat and rely upon the teat regaining its proper shape when the cap is removed to allow the liquid to flow past the member. All such forms are however subject to disadvantages concerning hygiene and also unreliability in operation.

It is the object of this invention to provide an infants feeding bottle in which operation is completely reliable without involving hygiene risks, and furthermore the bottle may be inexpensively produced so that disposal after use is economically realistic.

According to the present invention an infants feeding bottle comprises a container for liquid, having an outlet opening surrounded by a seating, a resilient teat with an outlet orifice, the teat having a portion secured onto the seating of the container by an attachment part, a teat cap enclosing the teat and connected to the attachment part by a severable portion, and a closure member frictionally engaged in the interior of the teat and arranged to be dislodged therefrom, to allow access between the interior of the container and the interior of the teat by manipulation of the cap while still enclosing the teat and subsequent upon severing of said severable portion between the cap and attachment part.

Figure 1:
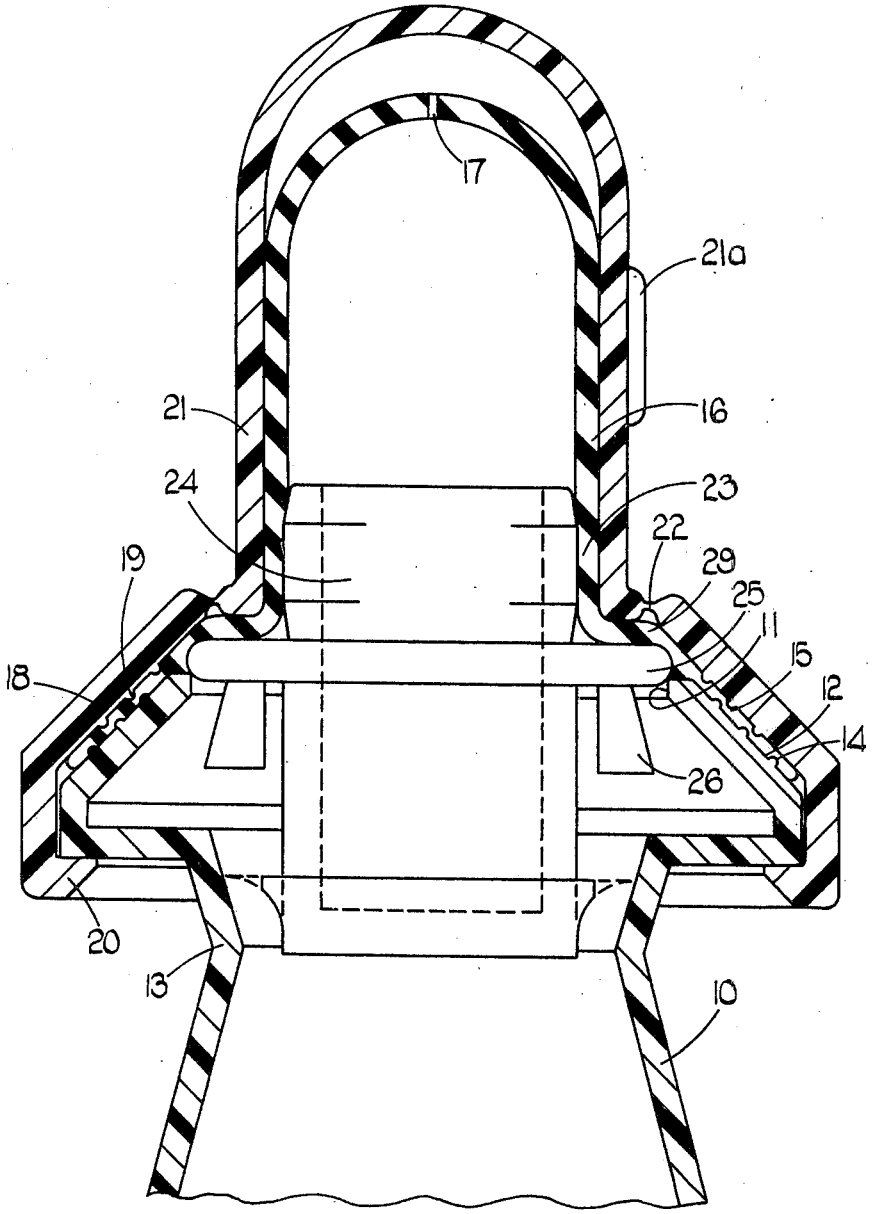
Figure 2:
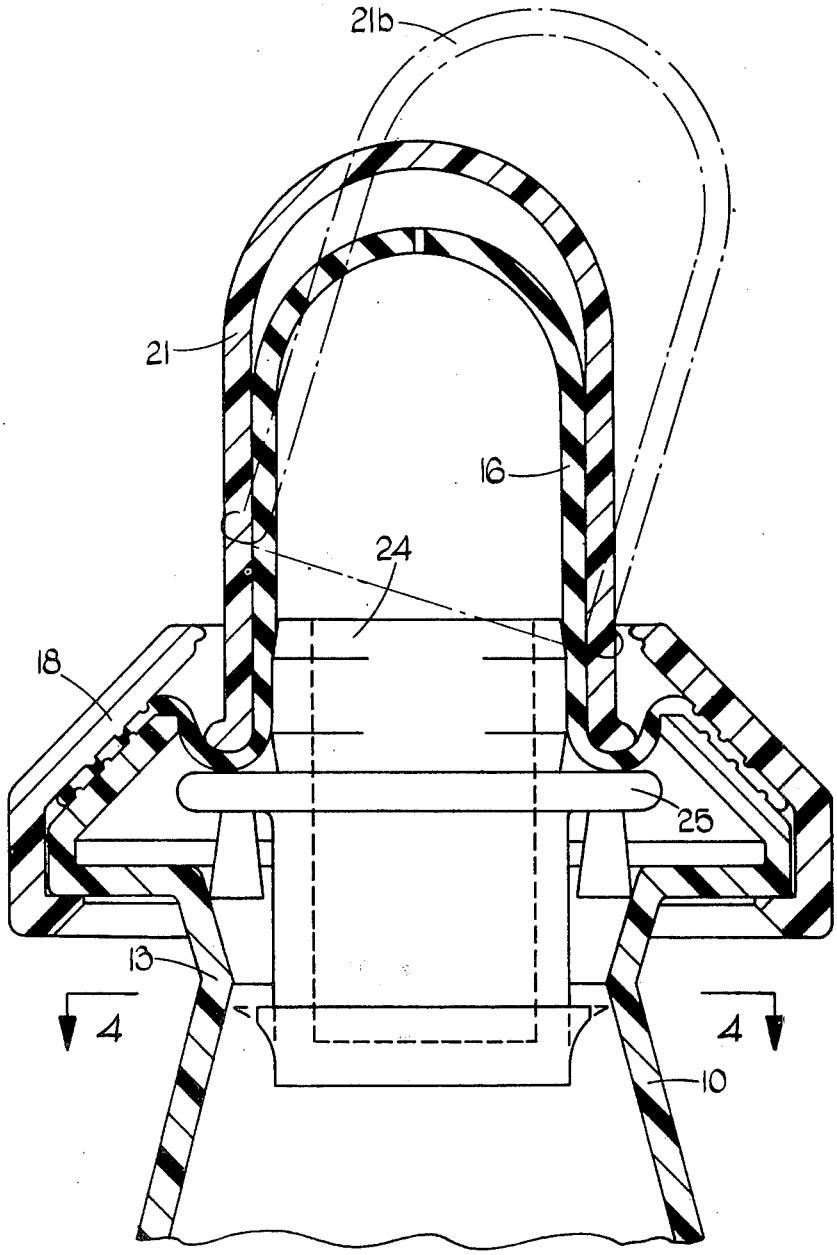
Figure 3:
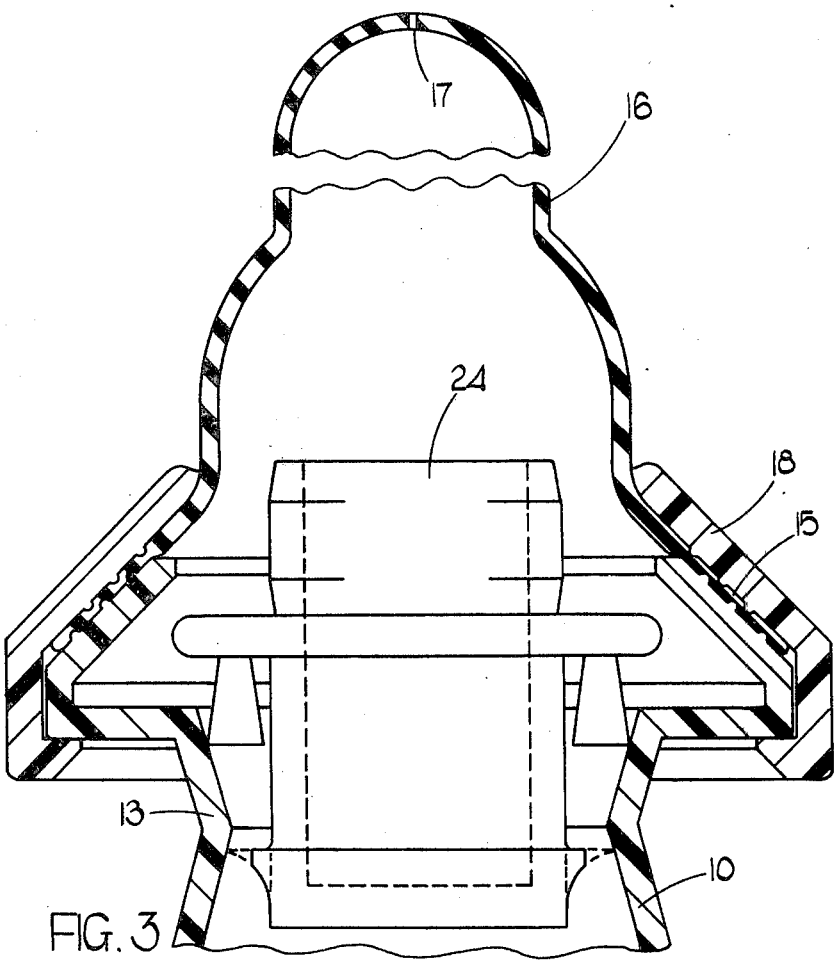
Figure 4:
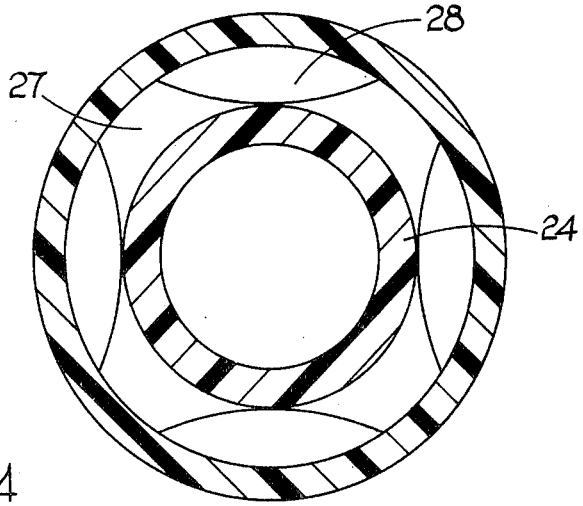
Figure 6:
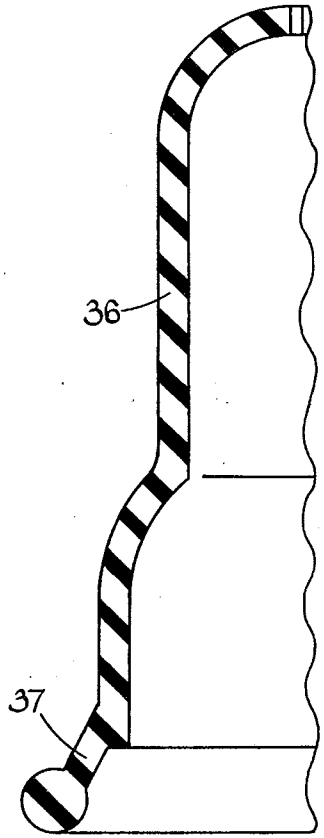
Figure 5:
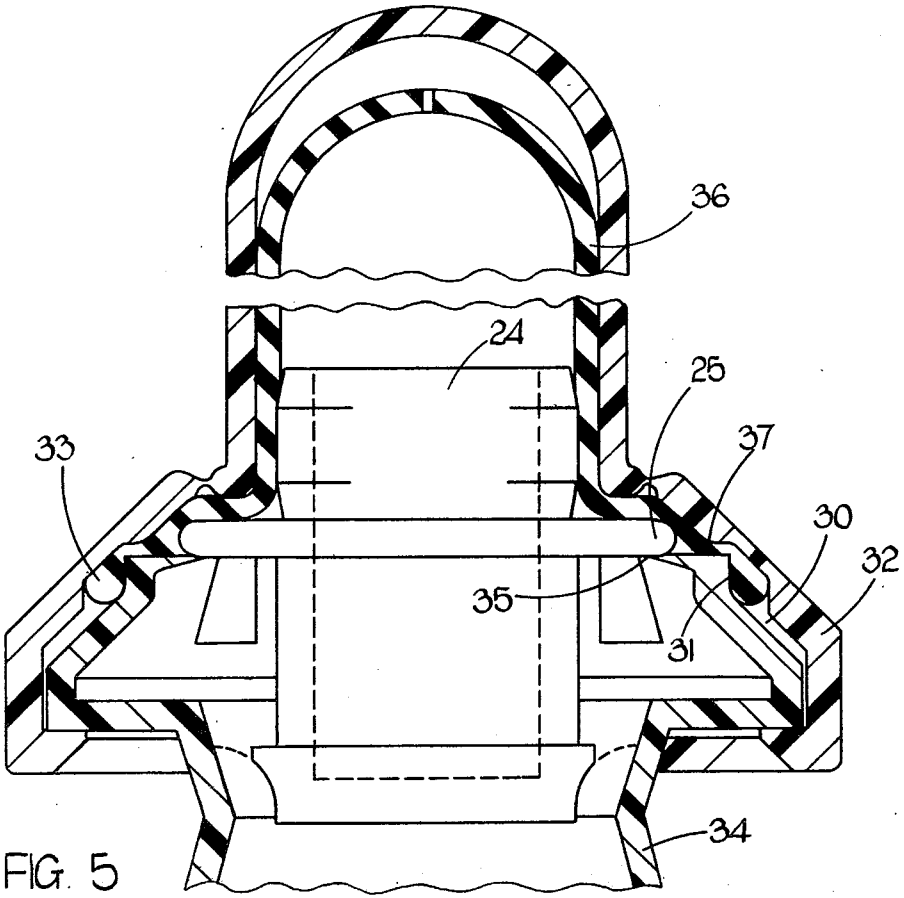
Figure 7:
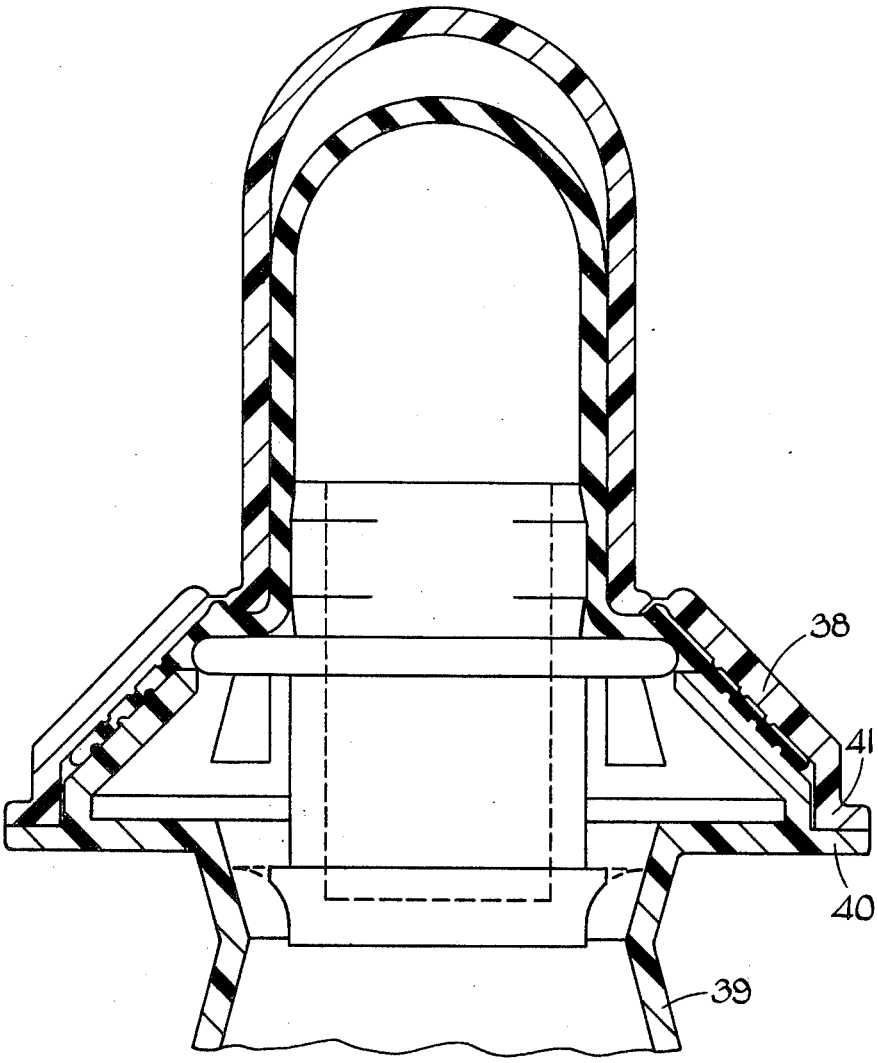
Figure 8:
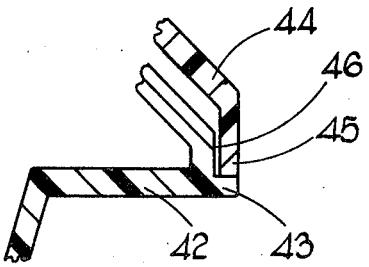

The invention will now be described by way of example with reference to the accompanying drawings in which:

FIG. 1 is a side elevation cross-sectional view of an infants feeding bottle constructed in accordance with the invention and shown in the sealed condition, FIG. 2 is a similar view but showing a stage in the process for making the bottle ready for use, FIG. 3 is a similar view showing the bottle in a condition ready for use, FIG. 4 is a cross-section on the line 4—4 in FIG. 2, FIG. 5 is a side elevation cross-sectional view of an alternative construction in accordance with the invention showing the bottle in the sealed condition, FIG. 6 is a part sectional view of a teat for use in the construction in FIG. 5, FIG. 7 is a side elevation cross-sectional view of a still further alternative construction shown in the sealed condition, and FIG. 8 is a scrap section of a still further alternative construction.

Referring to the construction of FIGS. 1 to 4 there is shown a feeding bottle comprising a container 10 having an opening 11 surrounded by a frusto conical seating 12. The seating is formed on the external surface of a enlarged mouth portion of the container which is defined by a narrow neck portion indicated generally at 13. The surface of the seating 12 is formed with annular ribs 14.

Engaging on the seating surface 12 is a flange 15 of a teat 16. The undeformed shape of the teat is illustrated in FIG. 3. The flange 15 is formed by a generally conical flare portion at one end and the other end is domed and provided with a single central outlet orifice 17.

To retain the teat flange 15 in sealing engagement with the seating 12 of the container 10 there is an attachment part 18. The attachment part has an internal frusto conical surface matching that of the seating 12 and having integral ribs 19 similar to those of the seating 12. The ribs 14 and 19 tend to deform the teat flange 15 so as to retain it firmly in place in tight sealing engagement with the seating 12. The attachment part 18 has an annular undercut flange 20 arranged to engage under the portion of the container 10 on which the seating 12 is formed. To allow the attachment part 18 to be fitted to the container, the surface of said undercut flange 20 is chamfered as shown. Both the container and the attachment part are formed from resilient materials to allow such snap engagement to be accomplished as will be described.

Formed integrally with the attachment part 18 is a teat cap 21. These parts are connected together by an integral continuous annular thin severable portion 22. This portion 22 provides a connecting zone which when it is intact prevents ingress of dirt to that portion of the teat 16 which is immediately within it. The attachment part 18 and cap 21 with the severable portion 22 are preferably formed by a moulding process from a plastics material and the severable portion 22 has sufficient strength to withstand normal handling during transport or storage of the feeding bottle, but when required, it can be broken away as indicated in FIG. 2. Breaking away of the severable portion 22 may be accomplished by rotation of the cap 21 relatively to the attachment part 18. To assist such rotation the cap has integral lugs 21*a* to offer a grip for the fingers. An alternative method of severing the portion 22 may however be to drive it inwards to the position indicated in full lines in FIG. 2 by application of pressure to the top of the cap.

The cap 21 is tightly engaged against the exterior surface of the teat 16 in the zone indicated at 23. Such tight engagement is produced by a closure member 24 which, in the sealed condition as shown in FIG. 1 has a plug portion of generally cylindrical external configuration. The edges of such plug portion are however shallowly chamfered as indicated, but the diameter of the cylindrical zone thereof is sufficiently large to place the zone 23 of the teat 16 in compression.

The closure member 24 is of unitary construction and is preferably moulded from a plastics material. It has an integral flange 25 from which depend a number of support lugs 26. The flange is adjacent the plug portion of the closure member, but the other end is formed with four projections 27. The edges of these are arcuate as shown in FIG. 4. These define between them four zones 28 through which liquid stored in the interior of the container 10, can flow into the upper part of the container and ultimately into the interior of the teat when the feeding bottle has been made ready for use.

The support lugs 26 and the projections 27 provide means for supporting the closure member 24 in a position within the narrow neck portion 13 of the container 10 as illustrated in FIGS. 2 and 3. The flange 25 is however slightly larger in external diameter than the opening 11 of the container 10. The edge of the flange 25 is rounded and it is possible to force the flange through the opening 11. Once it has passed through the opening the flange will not however return.

The rim of the cap 21 is disposed in the sealing condition, shown in FIG. 1 over the flange 25 and the teat 16 is compressed in the zone indicated at 29 between such rim of the cap 21 and the flange 25 of the closure member 24. This provides a means whereby the closure member 24 can be positively forced downwards by manipulation of the cap 21 between the positions shown in FIGS. 1 and 2 respectively.

Thus the operations for making the feeding bottle ready for use comprise the following. FIG. 1 shows the sealing condition and FIG. 2 shows in full lines the position of the cap 21 and of the closure member 24 after the severable portion 22 has been broken and the teat cap 21 moved downwardly. The closure member through the teat 16 has been moved to a position where its flange 25 has passed the opening 11 in the top of the container, and the support lugs 26 and the projections 27 have engaged on either side of the narrow neck portion 13 of the container.

This operation is carried out with the teat cap 21 covering the teat 16 at all times.

Also in FIG. 2 however is the dotted outline 21*b* of the cap during its removal from over the teat 16. In practice the first operation of dislodging the closure member 24 into the interior of the container may be carried out at a position remote from use, but the cap 21 remains in place until the feeding bottle is actually to be put to use. Only immediately before such use commences is the cap 21 removed.

Removal of the cap allows the teat 16 to become undeformed as shown in FIG. 3. Not only is it impossible for the closure member 24 to pass the opening 11 in the container 10 but, were it to do so, it would be impossible for the closure member 24 to re-engage in the interior of the teat since a degree of compression of the teat takes place during such insertion and the closure member 24 has insufficient weight to allow such compressive force to be exerted. Thus a completely reliable operation of the feeding bottle is accomplished, both during the process of making it ready for use, and during actual use.

The method of assembling the components comprises the following. First the teat 16 is inserted into the cap 21 which has formed integrally with it the attachment part 18. Next the closure member 24 is inserted into the interior of the teat, some pressure being necessary to accomplish this. Finally the whole of this assembly is secured onto the top of the container by the snap action afforded by the undercut flange 20 of the attachment part 18.

In FIG. 5 there is shown an alternative construction in which the form of the top of the container, and of the test flange and attachment part differ. The container has a frusto conical and the short cylinrical seating portion 30, 31 respectively. The attachment part 32 has a shallow annular groove 33 into which the edge of the cylindrical protion 31 engages. The opening 34 of the container 35 comprises an edge which because of its shape is relatively resilient to allow easy passage of the flange 25 of the closure member 24.

Trapped between the seating 30, 31 of the container 34 and the attachment part 32 is a flange 37 of the teat 36. This flange which is shown in its unstressed condition in FIG. 6 has a rolled Bead at its edge which becomes trapped in the space between the seating and the groove 33 in the attachment part 32. This form of teat is of smaller overall diameter than that in the construction shown in FIGS. 1 to 4 and it is therefore possible to make larger numbers of these by the inexpensive hot dip process. A bead on such a flange 37 is formed by rolling while the rubber latex from which the teat is made is still warm and tacky.

FIG. 7 illustrates a feeding bottle of the kind shown in FIGS. 1 to 4 with however an alternative arrangement for securing the attachment part 38 to the container 39. The container has an integral external annular flange 40 and the attachment part 38 has a similar external flange 41. These two flanges 40, 41 are secured together by a welding technique such as ultrasonic welding or alternatively by means of an adhesive.

In FIG. 8 a still further alternative construction is shown in which the container 42 has a short integral flange 43 and the attachment part 44 terminates in a cylindrical extension 45. Such extension is secured to the cylindrical surface portion 46 of the container adjacent its flange 43, by welding. A spin welding process may be adapted to provide a connection in this zone. Alternatively an adhesive may be used.

I claim:

1. An infants feeding bottle comprising a container for liquid having an outlet opening surrounded by seating, a resilient teat having an outlet orifice, the teat having a portion secured onto the seating of the container by an attachment part, a teat cap enclosing the teat and connected to the attachment part by a severable portion, and a closure member frictionally engaged in the interior of the teat and arranged to be dislodged therefrom, to allow access between the interior of the container and the interior of the teat by manipulation of the cap while the cap still encloses the teat, said cap being movable, after severing of said severable portion between the cap and the attachment part, in a direction towards the interior of the container to exert pressure on the closure member, through the teat, and dislodge said closure member from the teat into the interior of the container.

2. An infants feeding bottle as claimed in claim 1 in which the severable portion is a thin annular portion connecting the teat cap with the attachment part.

3. An infants feeding bottle as claimed in claim 1 in which the attachment part is secured to the container by a flange on said part which is adhered to a corresponding part of the container.

4. An infants feeding bottle as claimed in claim 1 in which the teat cap has portions thereon enabling it to be turned to sever the severable portion.

* * * * *